United States Patent [19]

Bowers, Jr.

[11] 4,397,154

[45] Aug. 9, 1983

[54] VORTEX GAS COOLER

[76] Inventor: Kenneth R. Bowers, Jr., 735 Shady La., Pittsburgh, Pa. 15228

[21] Appl. No.: 348,679

[22] Filed: Feb. 16, 1982

[51] Int. Cl.[3] ..... F25B 9/02
[52] U.S. Cl. ..... 62/5
[58] Field of Search ..... 62/5

[56] References Cited

U.S. PATENT DOCUMENTS

| | | | |
|---|---|---|---|
| 2,790,310 | 4/1957 | Green | 62/5 |
| 3,197,969 | 8/1965 | Over | 62/5 |
| 3,208,229 | 9/1965 | Fulton | 62/5 |

*Primary Examiner*—Ronald C. Capossela

[57] ABSTRACT

A vortex gas cooler having a compound fan which directly generates two gas stream vortex flows required for cooler operation.

5 Claims, 8 Drawing Figures

PRIOR ART

FIG 2
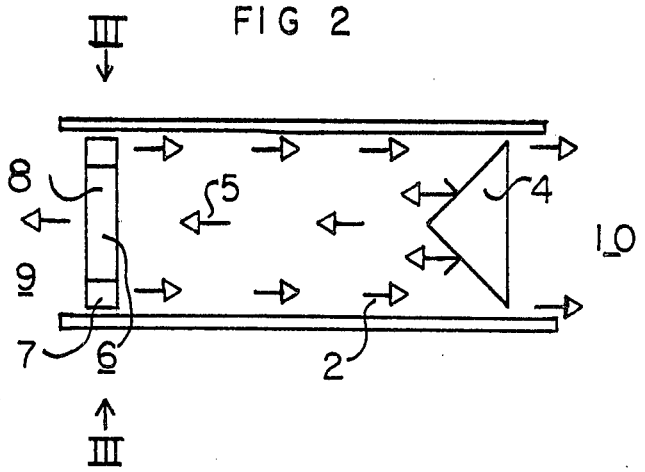
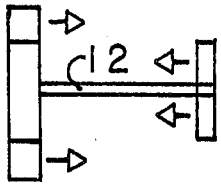
FIG 4
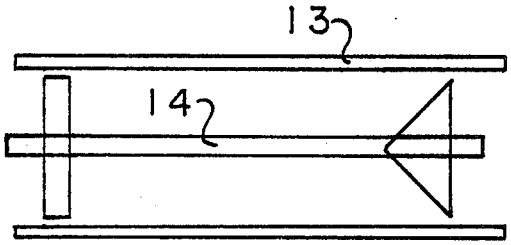
FIG 5

VORTEX GAS COOLER

BACKGROUND

This invention relates to an improved vortex gas cooling system.

The use of a vortex flow pattern to process a flow of a gas into hot and cold flow streams is described by an article entitled "A Short Course on Vortex Tubes and Application Notes," a publication of the Vortec Corporation, said article incorporated herein by reference.

Vortex coolers of the type described by the Vortec article require a source of pressurized gas since creation of a vortex is accomplished by flow through a nozzle having a shape appropriate to induce a vortex. It is considered that, less noise, lower weight, and smaller size will result if a vortex cooler can be provided which operates without gas compression or with reduced gas compression.

SUMMARY

The invented vortex gas cooler uses a fan to directly generate vortex flow. The fan has outer region blades which induce a vortex flow in a first direction, and inner region blades which induce a vortex stream in the opposite direction.

BRIEF DESCRIPTION OF THE DRAWINGS

FIG. 2 is a schematic profile of the improved vortex cooler;

FIGS. 4, 5 and 6 are schematics of alternative embodiments;

DETAILED DESCRIPTION

Figure 1:
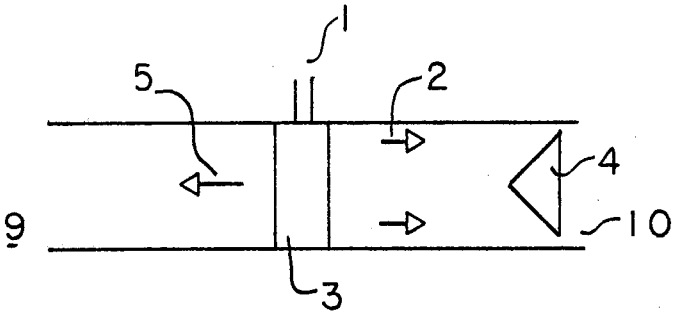
FIG. 1 is a schematic of a prior art vortex cooler.

As described in the Vortec article, and in FIG. 1, a vortex cooler uses a source 1 of pressurized gas (assumed to be air henceforth) to generate an outer vortex flow 2 in a generation chamber 3. This flow is reflected off a control valve surface 4 and becomes an inner oppositely moving vortex flow 5. Refer to the Vortec article for a detailed description of the operation and theory of a vortex cooler.

Figure 3:
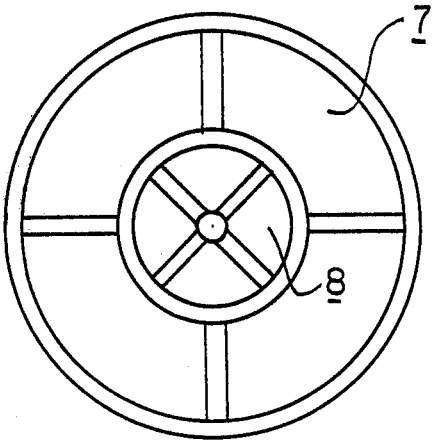
FIG. 3 is a section from FIG. 2.

By this invention, the vortex generation chamber 3 of the prior art is eliminated and the air flow streams within the vortex cooler are established directly by a fan 6. Refer to FIGS. 2 and 3. Fan 6 has an outer set of blades 7 which impel an outer vortex air flow 2. The inner region 8 of fan 6 may be a void which merely permits passage of the inner vortex flow 5 as established by valve 4, or inner region 8 may have a set of blades which aid or induce such vortex motion.

In the embodiment of FIG. 3, fan 6 is double acting; impeling two air flow streams in opposite linear directions with both streams having a circular motion. In FIG. 4, the two blade sets are shown separated, but may still be driven by a common shaft 12 if desired.

Figure 7:
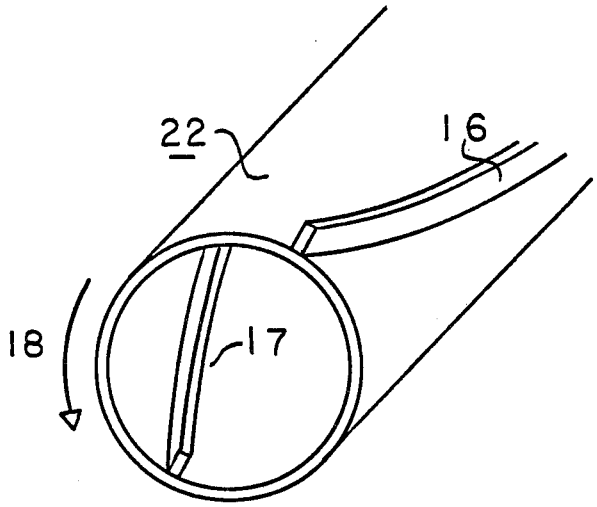
FIG. 7 is a schematic isometric of a fan impeller.
Figure 8:
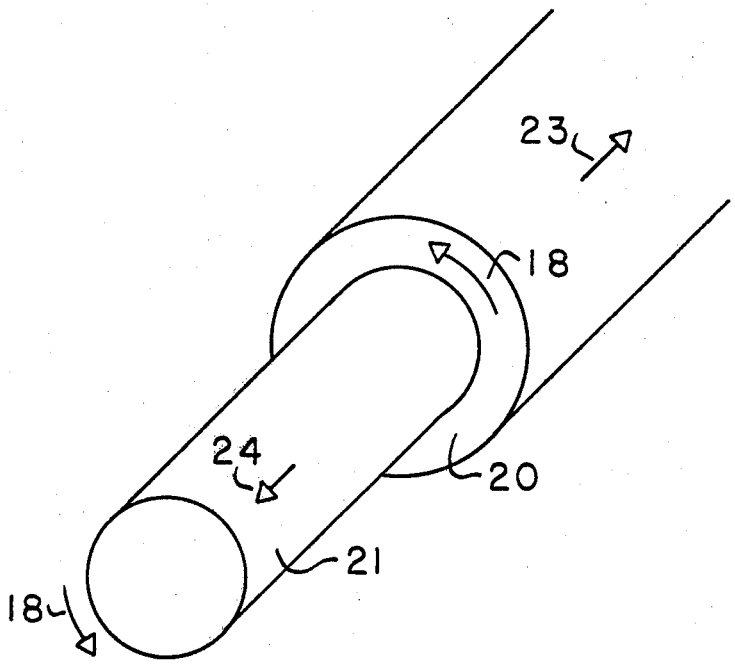
FIG. 8 is a schematic isometric of vortex air flow patterns.

FIG. 7 illustrates one possible method for creating the necessary air flow pattern which is shown by FIG. 8. A fan impeller 22 has outer blades 16 (one shown) which causes air flow 20; a counterclockwise rotation 18 and linear movement 23. Inner blades 17 (one shown) cause air flow 21; a counterclockwise rotation 18 and linear movement 24, opposite to linear movement 23. Fan impeller 22 is rotating counterclockwise 18 in FIG. 7.

Fan 6 is a compound fan which simultaneously forces air to flow in two opposed directions.

In FIG. 5, a cylindrical shaft 14 or wire is shown extending through the cooler. This shaft 14 improves the efficiency of the cooler because it fills a volume opposite the fan axle 12 which would cause local disturbances in flow streams in the absence of shaft 14. An electrostatic potential between shaft 14 and wall 13 may favorably influence cooler efficiency by increasing the interactions between air stream layers due to air ionization.

Shaft 14 may be an extension of the fan 6 axle as shown in FIG. 5 and may extend through valve 4 such that valve 4 rotates with fan 6. Valve 4 may even have blades to enable valve 4 to function as part of the fan. Shaft 14 may be supported and rotated by means located in the hot and cold outlet areas. (9 and 10 in FIG. 2)

It may be possible to eliminate valve 4 altogether, especially with the fan 6 configuration of FIG. 4.

Figure 6:
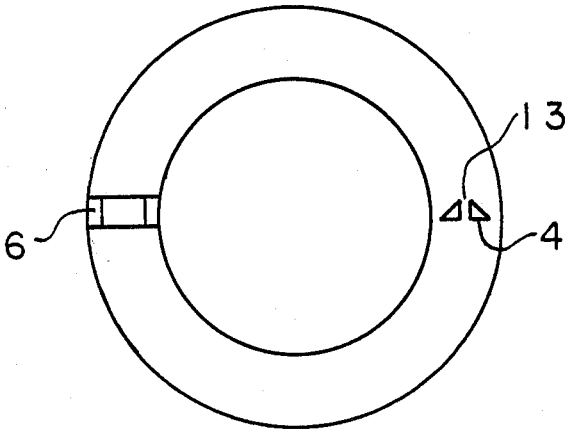

FIG. 6 illustrates a circular embodiment in which the air streams are allowed to make multiple passes around the tube. Valve 4 has a central hole 13 to permit passage of the inner flow 5. FIG. 6 does not include ports to siphon off portions of the hot and cold flow, or an inlet to provide fan suction air, but these of course must be provided.

The drawings do not illustrate means for rotating the fan blades. Rotational torque can be applied by a variety of means, including a belt.

While the device has been called a "cooler" herein, it does produce a stream of heated air which may in fact be the objective in certain applications. Therefore , the word "cooler" is intended to encompass a "heater" in the claims.

In the drawing and in the above specification it has been assumed that the two vortex air streams move in opposite linear directions because the prior art has that arrangement. Of course the fan may also impel two vortex flow streams moving in a common linear direction.

I claim:

1. A vortex gas cooler having:

(a) a cylindrical tube;

(b) a fan within said tube, said fan having outer region, rotatable fan blades disposed to impel an outer region vortex gas flow having circular motion and also moving through said tube in a first linear direction, said fan having an inner region which permits passage of an inner vortex gas flow within said outer vortex gas flow, said fan disposed to directly generate a gas vortex flow pattern within said tube.

2. The vortex gas cooler of claim 1 wherein said fan inner region has rotatable fan blades disposed to impel said inner region vortex gas flow.

3. The vortex gas cooler of claim 2 wherein said inner and outer region fan blades are disposed to impel vortex gas flow streams which have linear flow of opposite directions within said tube.

4. The vortex gas cooler of claim 1 wherein said fan has a central shaft extending along the axis of said tube, and an electrostatic potential is applied between said shaft and said tube.

5. The vortex gas cooler of claim 1 or 2, wherein said tube has a circular cross section, and said tube is formed into a circle such that said tube has a torus geometry.

* * * * *